US007849652B2

(12) United States Patent
Lehane et al.

(10) Patent No.: US 7,849,652 B2
(45) Date of Patent: Dec. 14, 2010

(54) SUSPENDED CEILING WITH MEASUREMENT INDICIA

(75) Inventors: James J. Lehane, McHenry, IL (US); Donald James Leahy, North Olmsted, OH (US)

(73) Assignee: United States Gypsum Company, Chicago, IL (US)

( * ) Notice: Subject to any disclaimer, the term of this patent is extended or adjusted under 35 U.S.C. 154(b) by 1070 days.

(21) Appl. No.: 11/595,598

(22) Filed: Nov. 9, 2006

(65) Prior Publication Data

US 2008/0110122 A1 May 15, 2008

(51) Int. Cl.
*E04B 9/10* (2006.01)
*E04B 9/30* (2006.01)

(52) U.S. Cl. ..... 52/506.06; 52/506.07; 52/105

(58) Field of Classification Search ..... 52/105, 52/506.07, 506.06, 831, 846, 850
See application file for complete search history.

(56) References Cited

U.S. PATENT DOCUMENTS

| | | | | | |
|---|---|---|---|---|---|
| 81,579 | A | | 9/1868 | Bailey | |
| 1,405,083 | A | | 1/1922 | Wilson | |
| 1,665,601 | A | * | 4/1928 | Wortimor | 52/105 |
| 3,374,596 | A | * | 3/1968 | O'Brien et al. | 52/664 |
| 3,477,184 | A | | 11/1969 | Johnson et al. | |
| 4,311,464 | A | | 1/1982 | Messina | |
| 4,351,113 | A | | 9/1982 | Eggertsen et al. | |
| 4,570,391 | A | * | 2/1986 | Quante et al. | 52/39 |
| 4,712,350 | A | | 12/1987 | Vukmanic | |
| 4,870,788 | A | | 10/1989 | Hassan | |
| 4,927,696 | A | | 5/1990 | Berg | |
| 5,148,644 | A | * | 9/1992 | Weir | 52/300 |
| 5,155,962 | A | | 10/1992 | Burkstrand et al. | |
| 5,611,185 | A | | 3/1997 | Wilz | |
| 5,729,946 | A | | 3/1998 | Beck | |
| 5,857,303 | A | | 1/1999 | Beck et al. | |
| 5,924,213 | A | * | 7/1999 | Lee | 33/494 |
| 5,979,134 | A | | 11/1999 | Neff | |
| 6,000,185 | A | | 12/1999 | Beck et al. | |
| 6,205,742 | B1 | | 3/2001 | Hahn | |
| 6,477,815 | B2 | * | 11/2002 | Paul et al. | 52/506.06 |
| 6,516,581 | B2 | | 2/2003 | Paul et al. | |
| 6,516,582 | B2 | * | 2/2003 | Paul et al. | 52/506.07 |
| 6,526,716 | B2 | * | 3/2003 | Paul | 52/506.06 |
| 6,625,939 | B1 | * | 9/2003 | Beck et al. | 52/105 |
| 6,758,016 | B2 | * | 7/2004 | Gobeil | 52/191 |
| 6,807,777 | B2 | * | 10/2004 | Wagner et al. | 52/204.1 |
| 7,028,438 | B2 | * | 4/2006 | Burdic | 52/409 |
| 7,150,128 | B2 | * | 12/2006 | Schuman et al. | 52/105 |
| 2002/0083656 | A1 | * | 7/2002 | Paul et al. | 52/105 |

(Continued)

*Primary Examiner*—Phi Dieu Tran A
(74) *Attorney, Agent, or Firm*—Greer, Burns & Crain, Ltd.; Pradip Sahu, Esq.; Philip T. Petti, Esq.

(57) ABSTRACT

A main tee member having a measurement indicia system for use with a suspended ceiling includes a support flange and a web extending upwardly from the support flange. The web has first and second sides and a plurality of receiving channels extending from the first side of the web to the second side of the web. The receiving channels are configured to receive a cross tee member. A plurality of first indicia are marked on the first side, and a plurality of second indicia are marked on the second side, and are disposed at the same incremental distances along the length of the main tee member for indicating the location of a selected receiving channel for receiving a first selected cross tee member, and for indicating the location of a selected receiving channel for receiving a second selected cross tee member to be introduced from the opposite side.

6 Claims, 5 Drawing Sheets

U.S. PATENT DOCUMENTS

2002/0083667 A1* 7/2002 Paul et al. ..... 52/506.06
2002/0083668 A1* 7/2002 Paul et al. ..... 52/506.06
2003/0154664 A1* 8/2003 Beck et al. ..... 52/105
2004/0000061 A1* 1/2004 Tuthill ..... 33/194
2004/0003563 A1* 1/2004 Burdic ..... 52/408
2004/0194417 A1* 10/2004 Paul ..... 52/716.8
2005/0210770 A1* 9/2005 Fackler ..... 52/105
2007/0022673 A1* 2/2007 Paul et al. ..... 52/105
2008/0229680 A1* 9/2008 Jahn et al. ..... 52/105
2009/0282751 A1* 11/2009 Orfield et al. ..... 52/105

* cited by examiner

SUSPENDED CEILING WITH MEASUREMENT INDICIA

BACKGROUND OF THE INVENTION

The present invention relates generally to suspended ceiling systems using a grid structure, and more particularly, to a suspended-ceiling system using a grid structure having measurement indicia.

Conventional suspended ceiling systems are typically hung with wire from ceiling joists or concrete slabs at selected locations to form a suspended grid structure. Hanging the grid structure creates a cavity between the joists and the ceiling where pipes, wires and ductwork can be installed and maintained.

In the installation of suspended ceiling systems, the installer typically forms the grid structure with multiple main tee members and multiple cross tee members. Starting at a first wall, the installer hangs a main tee member and works toward the opposite wall, connecting subsequent main tee members together as needed, until a composite main tee member runs the length of the room. Multiple parallel rows of main tee members are hung in this manner. Then, cross tee members are connected between adjacent main tee members at perpendicular angles. The cross tee members are connected into the main tee members by inserting a tab into a receiving channel of the main tee member. After all the main tee members and the cross tee members are in place, the ceiling tiles can be placed into the grid structure, where they rest on support flanges that extend from the main tee members and the cross tee members.

Conventionally, the main tee members are formed with multiple linearly spaced receiving channels along the length of the main tee member. The plurality of receiving channels allows the same main tee members to be used in different sized rooms, with different grid configurations and for different sized ceiling tiles. While providing multiple connection locations for the cross tee members, this configuration of multiple receiving channels on the main tee member can be confusing to the user. In assembling the metal grid, the installer must select the correct receiving channel from the plurality of receiving channels. Choosing the incorrect receiving channel will form an inconsistent or misaligned metal grid, and the installer will have to remove the cross tee member and re-install the member in the correct receiving channel. Such errors increase installation time and labor.

To address this problem, suspended ceiling systems using measurement indicia are known. U.S. Pat. No. 6,526,716, issued to Paul, discloses a suspended ceiling system having measurement indicia including color-coded receiving channels that correspond to selected cross tee members. A first side of the main tee member is painted with a first color scheme. A second side of the main tee member is also painted with the color scheme, however the color scheme is offset or shifted along the length of the main tee member relative to the first side. The purpose of marking two different indicia on two different sides is so that the main tee can be reversed yet it will still remain to have the same pattern on the referenced side when turned around. Apparently, only one side of the main tee member is used to employ reference marks to locate the cross tees.

However, one disadvantage of using different indicia on two different sides is that, once the user adopts a measurement indicia to employ as a reference point, the measurement indicia can only be seen from one side of the main tee member. That is, only one side of the main tee will inform the user of the correct placement of the cross tee member. On the second side, the measurement indicia does not apply, since the indicia is not aligned. Having the two different measurement indicia can cause confusion when the user works on the main tee member from both opposing sides.

Paul also discloses a measurement indicia scheme having a series of tick marks corresponding to half-inch increments along the length of the main tee. A disadvantage of this indicia scheme is that it is too precise of a system. It has been found that marking the members with half-inch increments would require a more complicated printing process accurately timed with the mechanical process which would reduce manufacturing speed of the main tee member. For this reason, measurement indicia printed at locations requiring a high tolerance dimension from a later processed end is not cost effective to manufacture at the present time.

U.S. Pat. No. 6,516,582, also issued to Paul, discloses a suspended ceiling system having measurement indicia including indentations and punch-out portions through a wall angle member. In this configuration, the measurement indicia are the same on both a first side and a second side of the wall angle member.

However, incorporating the wall angle member indicia system of U.S. Pat. No. 6,516,582 on a main tee member has multiple disadvantages. One disadvantage of punching out holes in the main tee member is that the main tee member may become distorted. Another disadvantage is that holes in the main tee member can create areas of localized weakness of the main tee member. As opposed to a wall angle member that is supportably mounted against a wall, main tee members are not supported along their length by a wall. Since the main tee member is a structural member that supports the weight of the ceiling system, providing holes in the member is not the most desirable solution.

Thus, there is a need for an improved suspended ceiling system incorporating measurement indicia that is visible from both sides of the web of the main tee member.

There is also a need for an improved suspended ceiling system incorporating measurement indicia that can be manufactured in a cost effective manner.

There is a further need for a suspended ceiling system incorporating measurement indicia that will maintain the structural strength of the main tee member.

BRIEF SUMMARY OF THE INVENTION

The above-listed needs are met or exceeded by the present main tee member having an improved measurement indicia system for use with a suspended ceiling grid structure where the member has aligned indicia that are marked on both sides of the member.

More specifically, a main tee member has a length and includes a support flange and a web extending upwardly from the support flange. The web has a first side and a second side and a plurality of receiving channels extending from the first side of the web to the second side. The receiving channels are spaced apart from each other and are configured to receive a cross tee member. A plurality of first indicia are marked on the first side, and a plurality of second indicia are marked on the second side. The first indicia and the second indicia are disposed at the same incremental distances along the length of the main tee member for indicating the location of a selected receiving channel for receiving a first selected cross tee member to be introduced from a first side, and for indicating the location of a selected receiving channel for receiving a second selected cross tee member to be introduced from the second side.

Also provided is a measurement system for use with a suspended ceiling grid structure having a plurality of main tee members each having a support flange and a web extending upwardly from the support flange. The web has a first side and a second side running a length of the main tee member, and a plurality of receiving channels extending from the first side to the second side that are spaced apart from each other. A plurality of cross tee members extend between the first and second main tee members. At least one main tee member has a plurality of first indicia marked on the first side and a plurality of second indicia marked on the second side, where the first indicia and the second indicia are disposed at the same incremental distances along the length of the main tee member for indicating the location of a selected receiving channel for receiving a first selected cross tee member to be introduced from the first side, and for indicating the location of the selected receiving channel for receiving a second selected cross tee member to be introduced from the second side.

A method for selecting the location of engagement of a plurality of cross tee members into a main tee member of a suspended ceiling where the main tee member has measurement indicia along its length includes placing a plurality of indicia along the length on a first side of the member, each of the indicia being located between selected adjacent receiving channels that are spaced along the length, and selecting a first indicator from a plurality of indicia. Further steps include selecting a first receiving channel that is closest to the first indicator than any other indicator, where the user selects one of at least one receiving channels to the left of the first indicator or the user selects one of at least one receiving channels to the right of the first indicator. The user selects a second indicator and selects a second receiving channel from at least one receiving channel located to the left or right of the second indicator, where the second receiving channel is in the same relative position to the second indicator as the first receiving channel is to the first indicator.

A process of making a main tee member having measurement indicia for use with a suspended ceiling grid structure, includes the steps of providing a blank of material having a length, re-flattening the blank to be sure it is generally planar, before passing under the printers then printing on the blank with a fast dry ink at a plurality of locations along the length of the blank, where at each location two indicia are printed on opposite sides of a centerline of the blank, and at a 180-degree relative orientation to each other. The step also includes drying the ink with a dryer, applying a lubricant to the blank, roll-forming the blank into a generally "T"-shaped member, and trimming the member into discrete generally "T"-shaped members.

DETAILED DESCRIPTION OF THE INVENTION

Figure 1:
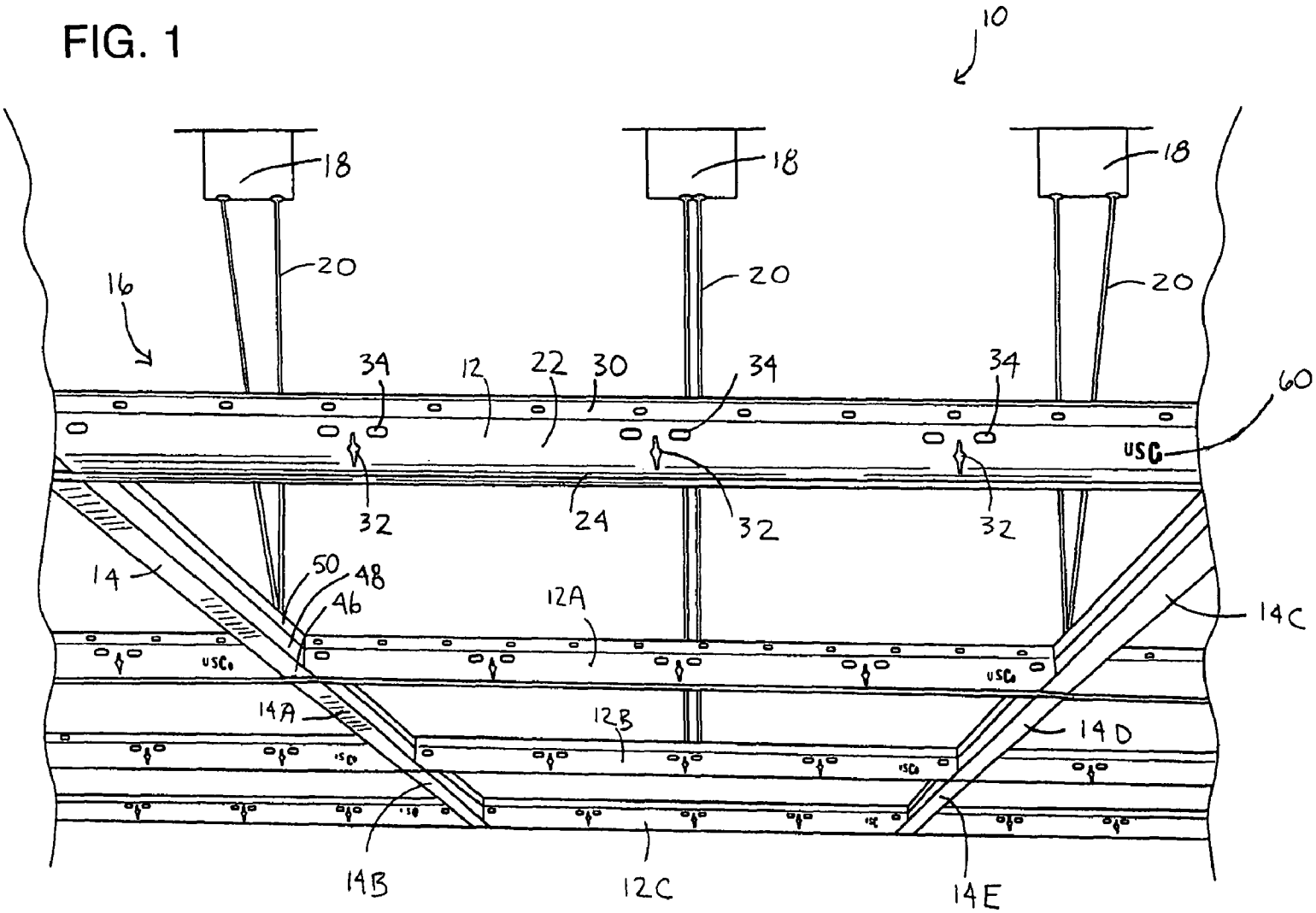
FIG. 1 is a fragmentary perspective view of a suspended ceiling grid structure with measurement indicia of the present invention.
Figure 2:
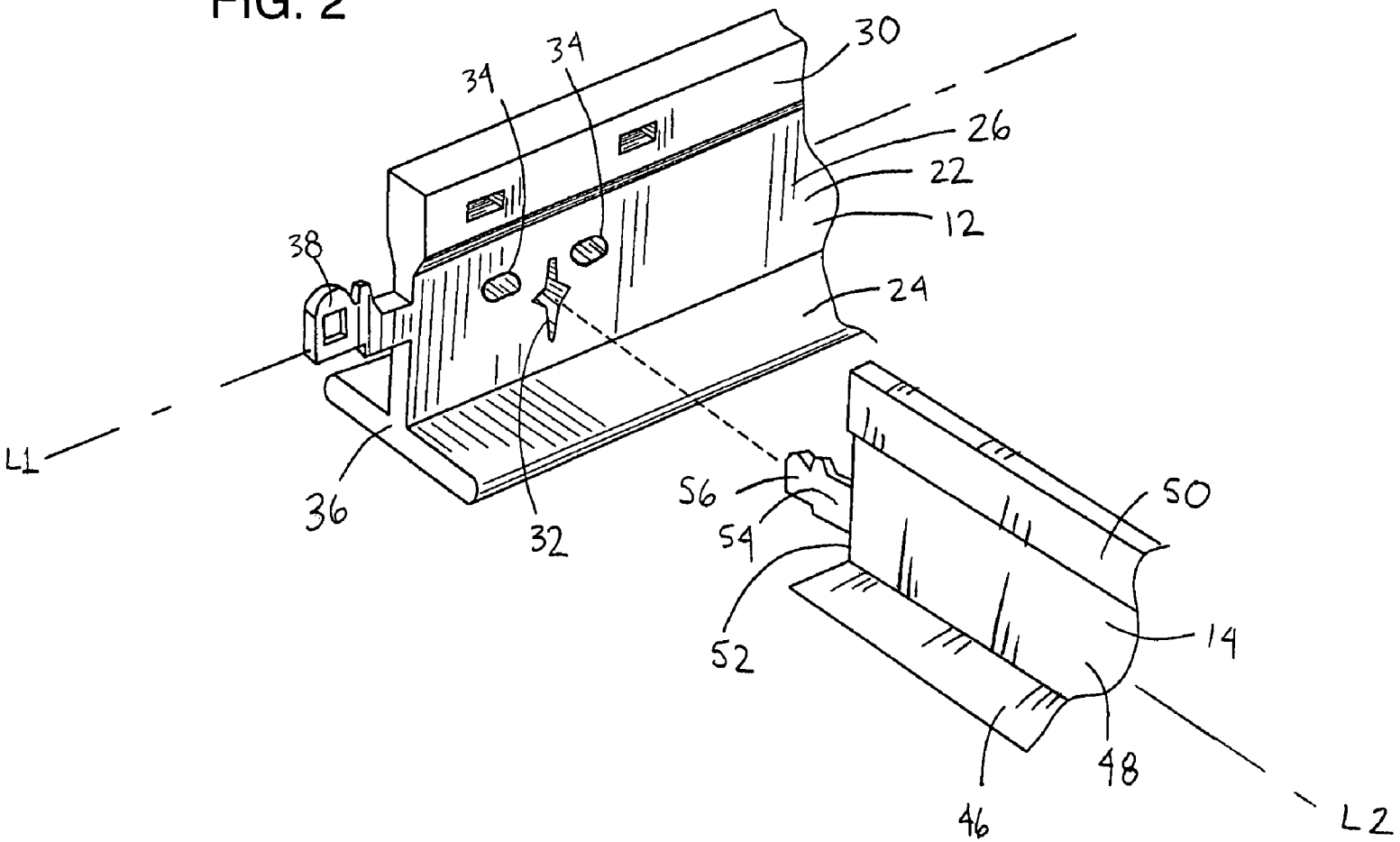
FIG. 2 is an exploded view of a main tee member and a cross tee member engageable in the main tee member.

Referring now to FIGS. 1 and 2, a suspended ceiling is depicted generally at 10, and includes a plurality of main tee members 12, 12A, 12B, 12C, and a plurality of cross tee members 14, 14A, . . . , 14E connected to the main tee members to form a grid structure 16. As is known in the art, the main tee members 12 are hung from a ceiling 18, schematically shown as joists, but slab ceilings are also contemplated, with a hanging wire 20 at selected locations along the members. The main tee members 12 are typically 12-feet in length, and multiple main tee members may be spliced together to run the length of a room. Preferably, oriented parallel and spaced apart from each other, the main tee members 12 receive ends of the cross tee members 14. After the grid structure 16 is complete, ceiling tiles (not shown) are placed into the grid.

Figure 3:
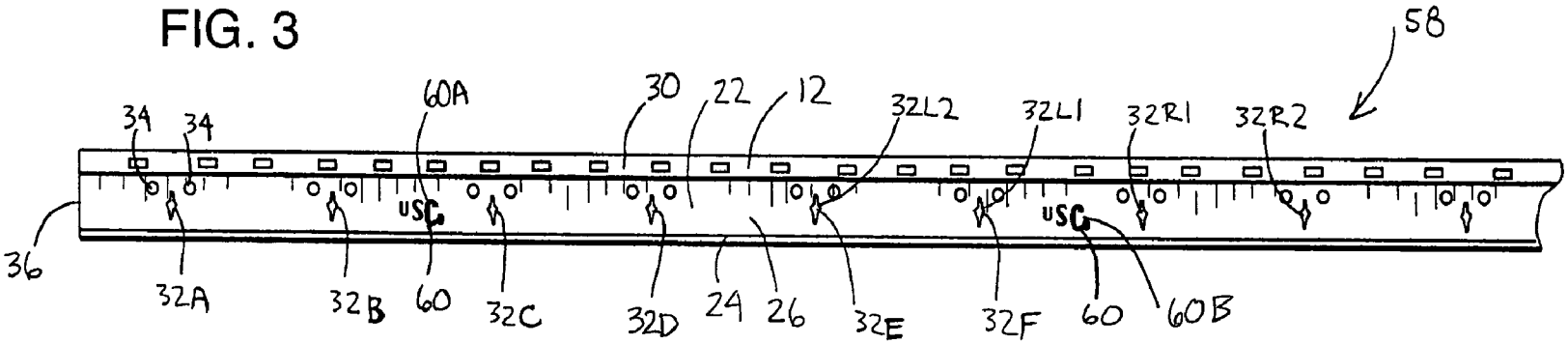
FIG. 3 is a plan view of a first side of the main tee member having the present measurement indicia along the length of the main tee.
Figure 4:
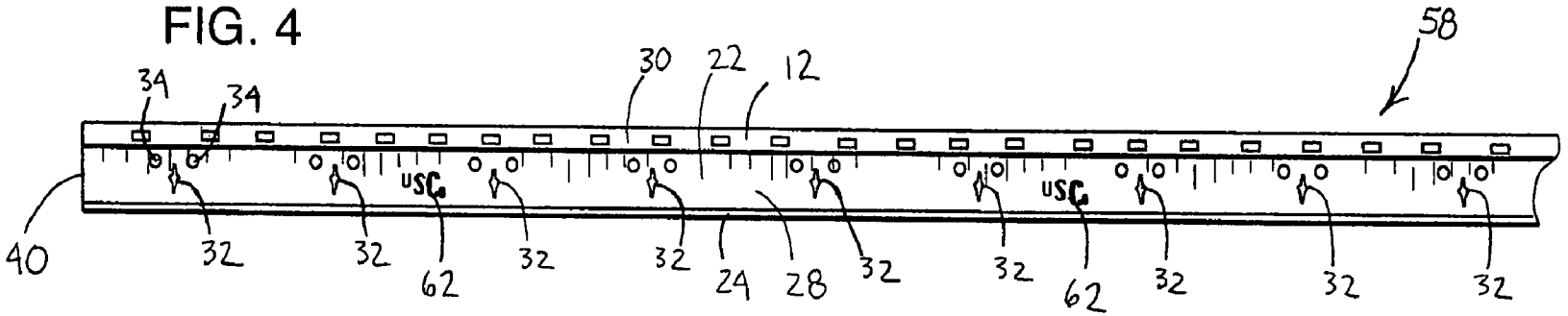
FIG. 4 is a plan view of a second side of the main tee member having the present measurement indicia along the length of the main tee, where the measurement indicia on the second side are located at the same locations as the measurement indicia on the first side.

Referring to FIGS. 2-4, the main tee member 12 is preferably symmetrical about a typically vertical axis transverse to a longitudinal axis "L1". The main tee member 12 includes a main web 22 and a main support flange 24 projecting from the main web at a first side 26 and a second side 28. The main support flange 24 is configured to support the peripheral edges of the ceiling tiles (not shown). Extending upward or vertically from the main support flange 24, the main web 22 forms an inverted "T" shape when viewed from the end (FIG. 2). Preferably above the main web 22 is a main upper flange 30 having a larger thickness than the web.

Included on the main tee member 12 is a plurality of receiving channels 32 extending through the main web 22 from the first side 26 to the second side 28. The receiving channels 32 are spaced apart from each other along the length of the main tee member 12. Preferably, the receiving channels 32 have a general diamond-shaped configuration, however other shapes or configurations for facilitating the engagement of the cross tee members 14 are contemplated. In the standard main tee member 12, the first receiving channel 32 is located approximately 3-inches from a first end 36 of the main tee member. The subsequent receiving channels 32 are disposed at additional increments of 6-inches.

A plurality of apertures 34 extending through the main web 22 are also disposed on the main tee member 12. The apertures 34 are preferably located at spaced intervals along the length of main tee member 12 for receiving the hanger wires 20. In the preferred embodiment, two apertures 34 are formed adjacent each receiving channel 32, with one aperture on either side and above the receiving channel. While oval (FIG. 1) shapes are disclosed, other shapes and arrangements of the apertures 34 are contemplated.

Optionally, the main tee member 12 has a first connector clip 38 on the first end 36 (FIG. 2), and a second end 40 with a second clip (not shown) generally similar to the first clip. The connector clip 38 may be attached to or integral with the main tee member 12, and is configured to be engageable with another main tee member as is known in the art for adjusting the length of the main tee member to fit a particular room.

The cross tee member 14 is also generally symmetrical about an axis transverse to a longitudinal axis "L2", and includes a cross support flange 46 and a cross web 48 extending upwardly or vertically from the cross support flange to form an inverted "T"-shape. The cross web 48 has a reduced thickness, and similar to the main upper flange 30, a cross upper flange 50 located above the web has an increased thickness.

The cross tee member 14 has a first end 52 with a first tab 54, and a second end (not shown) with a second tab (not shown) generally similar to the first tab. The tab 54 is attached to or integral with the cross tee member 14 and is configured to be engageable with a selected receiving channel 32 in the main tee member 12. Each receiving channel 32 is configured for receiving the first tab 54 at the first side 26 of the main tee member 12, the second tab at the second side 28 of the main tee member, and is sufficiently wide to receive both the first tab and the second tab at both the first and second sides. In the latter case, the tabs 54 are located side-by-side in the receiving channel 32. The tabs 54 preferably include a tab portion 56 that interlocks with the side edge of the receiving channel 32.

When the main tee members 12 and the cross tee members 14 are attached to form the grid structure 16, the main support flanges 24 of two adjacent main tee members and the cross support flanges 46 of two adjacent cross tees form an open, aligned rectangular platform for receiving the peripheral edges of the ceiling tile (not shown).

Referring now to FIGS. 3 and 4, the preferred embodiment of measurement indicia system is indicated generally at 58, and includes a measurement indicator 60 located on the main web 22. The preferred measurement indicator 60 is a marking of the registered trademark "USG" along the length of the main tee member. While "USG" is the preferred indicator 60, it is contemplated that any marking symbol, including shapes, letters, numbers or combinations of the above can be used. The measurement indicia system 58 aids the user in identifying the correct location of the placement of cross tee members 14 in forming the suspended grid structure 16.

In the preferred embodiment, the indicator ("USG") 60 is printed one-foot (12-inches) from the first end 36, and additionally at 2-foot (24-inch) increments from the initial printing. The indicator pattern repeats along the length of the main tee member 12. In a typical 12-foot main tee member 12, the "USG" indicator 60 repeats six times, specifically at the one-foot (1'), three-foot (3'), five-foot (5'), seven-foot (7'), nine-foot (9') and eleven-foot (11') increments from the first end 36 of the main tee member to the second end 40.

The receiving channels 32 of the preferred embodiment are located along the length of the main tee member 12, the first receiving channel 32A being located three-inches (3") from the first end 36 of the main tee member 12. The subsequent receiving channels 32 are preferably located at additional six-inch (6") increments from the first receiving channel 32A.

With this configuration, the location of each "USG" indicator 60 is located between two receiving channels 32, and each "USG" indicator has two receiving channels located to the left that are closest to that specific "USG" indicator (see FIGS. 3, 32L1, 32L2), and two receiving channels to the right that are closest to that specific "USG" indicator (see FIGS. 3, 32R1, 32R2). Specifically, and in the direction from the first end 36 to the second end 40 of the main tee member 12, the first receiving channel 32A is located at three-inches (3") from the first end, followed by a second receiving channel 32B located six-inches (6") from the first receiving channel, followed by an indicator 60A located three-inches (3") from the second receiving channel, followed by a third receiving channel 32C located three-inches (3") from the indicator 60A, and a fourth receiving channel 32D located six-inches (6") from the third receiving channel. Continuing in the same direction, a fifth receiving channel 32E is six- inches (6") from the fourth receiving channel 32D, and a sixth receiving channel 32F is six-inches (6") from the fifth receiving channel. A second indicator 60B is located three-inches (3") from the sixth receiving channel 32F.

When the user wants to install the grid structure 16 using the preferred measurement indicia system 58, the user has four options. The first option is to insert the cross tee members 14 in the first receiving channel 32L1 to the left of the indicator 60, and the second option is to insert the cross tee members in the second receiving channel 32L2 to the left of the indicator 60. The third option is to insert the cross tee members 14 into the first receiving channel 32R1 to the right of the indicator 60, and the fourth option is to insert the cross tee members into the second receiving channel 32R2 to the right of the indicator 60.

The reverse or second side 28 of the main tee member 12 is depicted in FIG. 4. In viewing FIG. 3, the first end 36 is to the left, and in viewing FIG. 4, the second end 40 is to the left. As can be seen in comparing FIG. 4 to FIG. 3, the reverse or second side 28 of the main tee member 12 has the same measurement system 58 as the first side 26, and a second set of indicia 62 on the second side 28 are aligned with the first set of indicia 60 on the first side 26. In this configuration, the indicia 60 on the first side 26 of the main tee member 12 will inform the user on the correct placement of the first cross tee member 14 in a selected receiving channel 32, and the aligned indicia 62 on the second side 28 of the main tee member 12 will inform the user on the correct placement of the second cross tee member to be placed in the same selected receiving channel 32. The indicia 60, 62 will inform the user from both sides of the main tee member 12, using the same measurement indicia system 58 on each side 26, 28.

The preferred indicator 60, 62 is the registered trademark "USG" since the indicator plays a dual role in aiding placement of the cross tee members 14 and advertising the source of the product. Further, the location of the "USG" indicator 60, 62 is such that, when used with standard ceiling tile sizes, when any one ceiling tile is removed from a suspended ceiling system, a "USG" indicator will likely be exposed. However, the indicator 60, 62 is not limited to the "USG" trademark, nor does every indicator along the length of the main tee member 12, or among main tee members, need to be the same marking.

Figure 7:
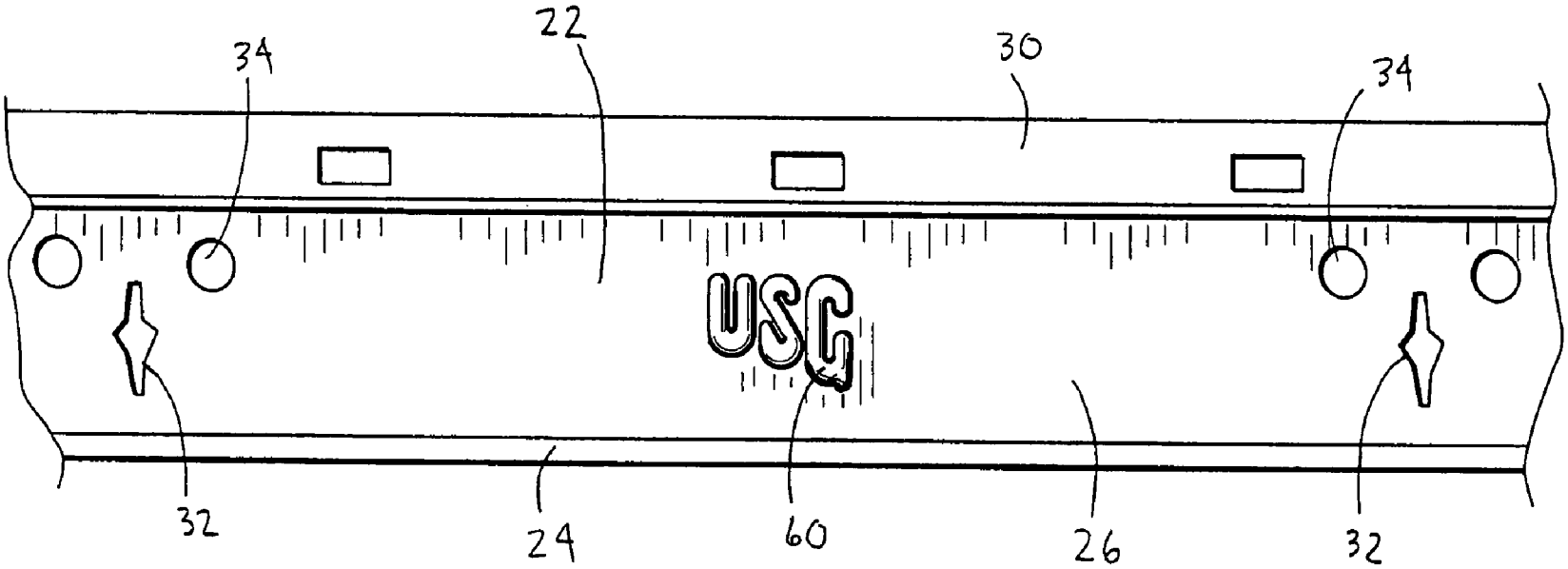
FIG. 7 is a plan view of a main tee member having an alternate embodiment of the present measurement indicia.

It will be appreciated that other arrangements of measurement indicia 60, 62 can be used. For example, the number of indicia 60, 62 along the length of the main tee member 12 can vary. Also, the placement of the marking indicator 60, 62 on the main web 22 can vary. For example, there can be a different number of receiving channels 32 on each side of the marking indicator 60, 62. Further, while the preferred embodiment includes printing the indicator 60, 62 onto the main tee member 12, alternatively, the indicator can be embossed as seen in FIG. 7.

Figure 5:
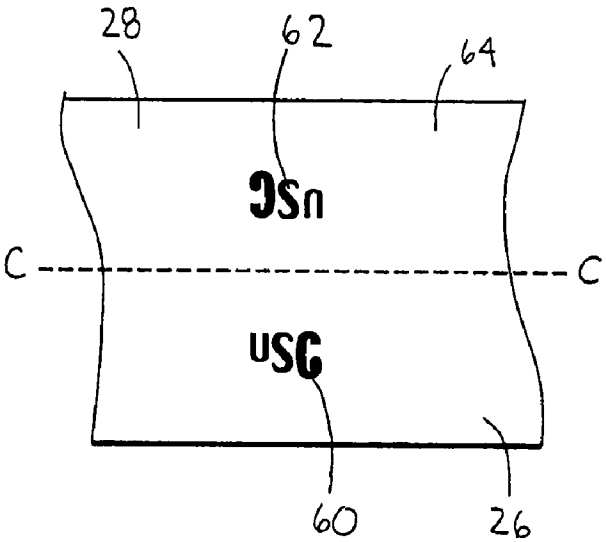
FIG. 5 depicts a blank of material to be manufactured into a tee member with the measurement indicia printed on a top surface.
Figure 6:
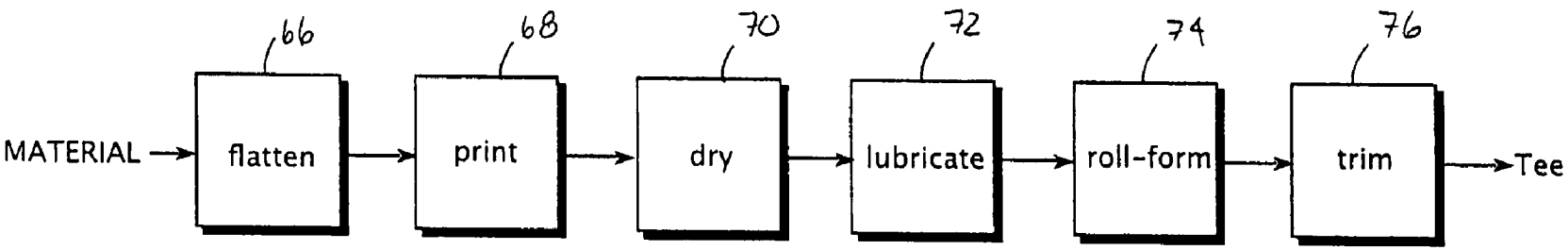
FIG. 6 is a flowchart of the process of manufacturing a main tee member having the present measurement indicia.

Referring now to FIGS. 5 and 6, the main tee member 12 having a printed indicator 60, 62 is preferably manufactured by unrolling a coil of steel or other suited materials into a generally planar shaped blank 64.

As is known in the art, the blank 64 is flattened at step 66 with a coil guiding machine to roll-out any damaged areas on the material before it travels under the printheads. Damaged edges are frequently acquired during shipping and handling of the coils.

Then, the blank 64 is printed at step 68 at two locations on opposite sides of a centerline C and at a 180-degree orientation from each other (FIG. 5). This allows the indicator 60, 62 to be readable from both sides of the main tee member 12 after the member is completely formed. When the indicator 60, 62 is being printed, the blank 64 is pulled through a machine that guides, holds flat, and controls vibration while the blank travels under the print heads. The print heads preferably aim directly down and perpendicular to the blank 64. Alternately, the indicator 60, 62 may be embossed onto the blank 64 (see FIG. 7).

After being printed with fast dry ink, the ink on the blank 64 is dried at step 70 with a dryer. The dryer may use forced air, heat or both. When the ink is sufficiently dry, the blank 64 is lubricated at step 72 and run through a roll-forming machine to form it at step 74 into the general "T" shape. Finally, the main tee members 12 are trimmed at step 76 into 12-foot lengths, or whatever other length is desired. Connectors 38 can be added to the first and second ends 36, 40 of the main tee members 12.

When the number of indicia 60, 62 to be printed on the blank 64 increases, the precision of the printer 68 must increase. A desired speed at which the blank 64 travels through the printing process 68 is about 600-feet per minute. At this speed, it is difficult to attain the precision required with prior art measurement indicia schemes. However, with the present measurement indicia system 58, the indicia 60, 62 are located at enough locations to easily inform the user of the proper placement of cross tee members 14, but are not so numerous as to slow down the production time to obtain adequate precision. Further, there is more room for error with the preferred marking indicator 60, 62 because as long as the indicator is located between two receiving channels 32, it can inform the user where to place the cross member tees 14. Thus, the manufacturing process can run at higher speeds.

It has been found that marking aligned indicia on both sides of main tee members provides a simple, cost effective system for identifying the locations of placement of cross tee members. As such, assembling a grid structure using the present main tee member is easier for the user. Further, printing the indicators on the main tee member does not compromise the strength of the member.

While particular embodiments of the present main tee member 12, measurement system, method of using and method of making same have been shown and described, it will be appreciated by those skilled in the art that changes and modifications may be made thereto without departing from the invention in its broader aspects and as set forth in the following claims.

The invention claimed is:

1. A main tee member having a measurement indicia system for use with a suspended ceiling grid structure, said main tee member having a length and comprising:

a support flange;

a web extending upwardly from said support flange, said web having a first side and a second side extending the length of the main tee member;

a plurality of receiving channels extending from said first side of said web to said second side of said web, said receiving channels spaced apart from each other and disposed along the length of the main tee member, said receiving channels configured for receiving a cross tee member;

a plurality of first indicia marked on said first side; and a plurality of second indicia marked on said second side;

wherein said first indicia and said second indicia are disposed on said web between two adjacent receiving channels, wherein said web between at least two other adjacent receiving channels is indicia free, for indicating the location of a selected receiving channel for receiving a first selected cross tee member to be introduced from said first side, and for indicating the location of said selected receiving channel for receiving a second selected cross tee member to be introduced from said second side.

2. The main tee member of claim 1 wherein each of said plurality of first and second indicia have at least one receiving channel located between adjacent indicia on the same side of said web.

3. The main tee member of claim 1 wherein each of said plurality of first and second indicia is bounded on both sides of the length of the main tee member with at least one receiving channel that is located closer to said indicator than any other indicator on the same side of said web.

4. The main tee member of claim 3, wherein each of said plurality of first and second indicia is bounded on both sides of the length of the main tee member with two receiving channels that are located closer to said indicator than any other indicator on the same side of said web.

5. The main tee member of claim 1 wherein said receiving channels are located along the length of said web starting at 3-inches from a first end, and at 6-inch increments thereafter until a second end of said web, and said first and second indicia are located along the length of said web starting at 1-foot from said first end, and at a 2-foot increment thereafter.

6. The main tee member of claim 1 wherein said first and second indicia are one of printed and embossed on said main tee member.

* * * * *